US007021976B2

(12) United States Patent
Sekiguchi

(10) Patent No.: US 7,021,976 B2
(45) Date of Patent: Apr. 4, 2006

(54) SPRING CONNECTOR

(75) Inventor: Toru Sekiguchi, Yamanashi-ken (JP)

(73) Assignee: Citizen Electronics Co., Ltd., Yamanashi-ken (JP)

( * ) Notice: Subject to any disclaimer, the term of this patent is extended or adjusted under 35 U.S.C. 154(b) by 0 days.

(21) Appl. No.: 11/092,724

(22) Filed: Mar. 30, 2005

(65) Prior Publication Data

US 2005/0227546 A1 Oct. 13, 2005

(30) Foreign Application Priority Data

Apr. 8, 2004 (JP) ..... 2004-114422

(51) Int. Cl.
*H01R 13/24* (2006.01)

(52) U.S. Cl. ..... 439/824

(58) Field of Classification Search ..... 439/824, 439/700, 482, 66

See application file for complete search history.

(56) References Cited

U.S. PATENT DOCUMENTS 2,644,145 A * 6/1953 Adams ..... 439/824
4,397,519 A * 8/1983 Cooney ..... 439/824
5,159,265 A * 10/1992 Alfonso et al. ..... 324/761
5,600,199 A * 2/1997 Martin et al. ..... 313/318.02
5,641,315 A * 6/1997 Swart et al. ..... 439/824
5,749,754 A * 5/1998 Patterson et al. ..... 439/824
6,104,205 A * 8/2000 Mawby ..... 324/761
6,340,320 B1 * 1/2002 Ogawa ..... 439/824
6,663,439 B1 * 12/2003 Henry et al. ..... 439/700
6,696,850 B1 * 2/2004 Sanders ..... 324/761
6,758,682 B1 * 7/2004 Kosmala ..... 439/66
6,776,668 B1 * 8/2004 Scyoc et al. ..... 439/700
6,796,850 B1 * 9/2004 Matsui et al. ..... 439/700
6,957,986 B1 * 10/2005 Jing ..... 439/700
2002/0081910 A1 * 6/2002 Kihira et al. ..... 439/700
2004/0077225 A1 * 4/2004 Chun-Fu ..... 439/700
2004/0137800 A1 * 7/2004 Jing ..... 439/700
2004/0161981 A1 * 8/2004 Matsui et al. ..... 439/824
2004/0224570 A1 * 11/2004 Yeh ..... 439/824
2004/0224571 A1 * 11/2004 Yeh ..... 439/824
2004/0266272 A1 * 12/2004 Maruyama et al. ..... 439/700
2005/0026510 A1 * 2/2005 Orihara ..... 439/700

* cited by examiner

*Primary Examiner*—Ross Gushi
(74) *Attorney, Agent, or Firm*—Dennison, Schultz, Dougherty & MacDonald

(57) ABSTRACT

A spring connector comprises a supporting member, a cylindrical plunger, and a coil spring provided in the cylindrical plunger. The supporting member has a base, a pillar extended from the base, and a shoulder and a head having a diameter larger than that of the pillar. The upper end of the head has an inclined surface. The plunger has a closed upper end, an opening formed in an annular bent portion of a lower end thereof. An annular edge of the opening is slidably engaged with the supporting member at the shoulder thereof. The coil spring is provided between the closed upper end and the inclined surface of the head so that a shoulder formed on the head at a lower annular periphery is pressed against the annular bent portion of the opening.

4 Claims, 2 Drawing Sheets

SPRING CONNECTOR

BACKGROUND OF THE INVENTION

The present invention relates to a connector used for surface mounting on a circuit substrate in an electronic device, particularly relates to a connector having a plunger resiliently urged by a spring so that the upper end of the connector may press terminal electrodes of electric parts to be electrically connected to the circuit substrate in the electronic device.

In an electronic device such as a portable telephone, a portable computer, and a game console, there are provided spring connectors for connecting battery, acoustic parts, peripheral circuits and other electric parts to a circuit substrate of the electronic device. Japanese Patent Application Laid-Open 2002-25657 discloses on page 3 and in FIG. 2(D), one of these spring connectors. The spring connector has a plunger which is slidably mounted in a tube and outwardly urged by a spring. The spring connector is secured to a circuit substrate and the plunger is pressed against a terminal electrode of the electric part in assembling process of the part in the device, thereby electrically connecting the part to the circuit substrate.

FIGS. 2 and 3 show similar conventional spring connectors.

Referring to FIG. 2, the spring connector comprises a cylindrical tube 11 made of metal, and a metal plunger 13 slidably inserted in the tube 11 and outwardly urged by a coil spring 12. A shoulder 13*c* of a flange 13*a* of the plunger 13 is pressed against a bent edge 11*a* of the tube 11 by the coil spring 12 so as not to slide out of the tube 11. The outer surfaces of the tube 11 and the plunger 13 are covered by nickel and gold plating. Both the tube 11 and the plunger 13 are formed by cutting work.

FIG. 3 shows another conventional spring connector provided with a plunger 13A. The plunger 13A has the flange 13*a*, an underside 13*d* of which is inclined so that the peripheral wall of the flange is pressed against the inner surface of the tube 11 in an inclined condition. Thus the flange is strongly pressed against the inner surface, thereby ensuring the electrical conductivity between the tube and the plunger. In the present spring connector, the plunger 13A is formed using a header instead of by cutting so that the manufacturing cost is decreased. The header is a processing machine to press or squash a metal material to form into a predetermined shape.

In each of the above described spring connectors, there is a problem of dirt entering the tube. Accordingly, the contact resistance between the plunger and the spring is unstable. Particularly in the case of the spring connector of FIG. 2, since the underside of the plunger is not inclined, the contact resistance is even more unstable. Moreover, although the plunger is formed with header in the spring connector of FIG. 3, since the tube must be manufactured by cutting in both cases, the manufacturing cost cannot be sufficiently decreased.

SUMMARY OF THE INVENTION

An object of the present invention is to provide a spring connector which is excellent in performance and may be manufactured at a low cost.

According to the present invention, there is provided a spring connector comprising a supporting member having a base, a pillar formed on the base, a head having a diameter larger than that of the pillar, an annular shoulder formed between the pillar and the head, and an upper end of the head having an inclined surface, a cylindrical plunger having a closed upper end, an inner space, an opening formed in an annular bent portion of a lower end thereof, an annular edge of the opening being slidably engaged with a peripheral wall of the pillar, a coil spring provided in the inner space of the cylindrical plunger between the closed upper end and the inclined surface of the head so that the shoulder of the head is pressed against the annular bent portion of the opening.

The supporting member is formed by using a header, that is a processing machine to press or squash a metal material to form into a predetermined shape, and the annular bent portion of the plunger is formed by squeezing. Namely, a squeeze machine, after the supporting member is inserted in the plunger, squeezes the end of the plunger. The squeezing is a processing method to press the annular opening end of the plunger to be bent inwardly.

The surfaces of the supporting member and plunger are coated with Au plating.

These and other objects and features of the present invention will become more apparent from the following detailed description with reference to the accompanying drawings.

DETAILED DESCRIPTION OF THE PREFERRED EMBODIMENT

Figure 1:
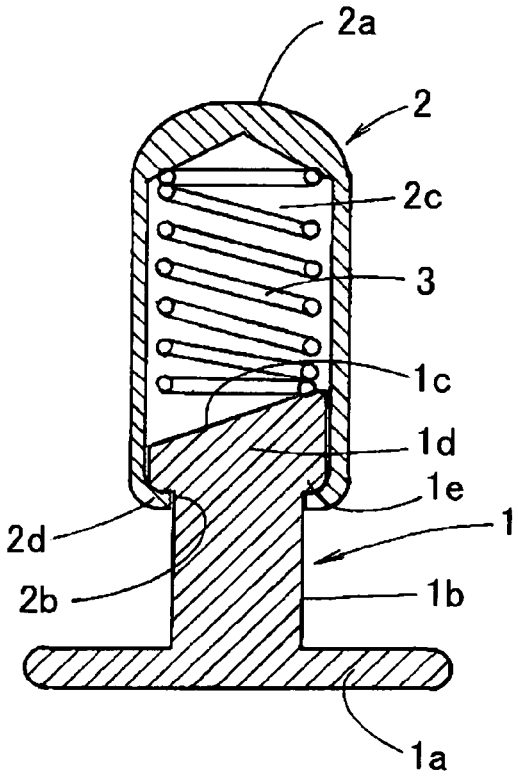
FIG. 1 is a sectional view of a spring connector according to the present invention.
Figure 2:
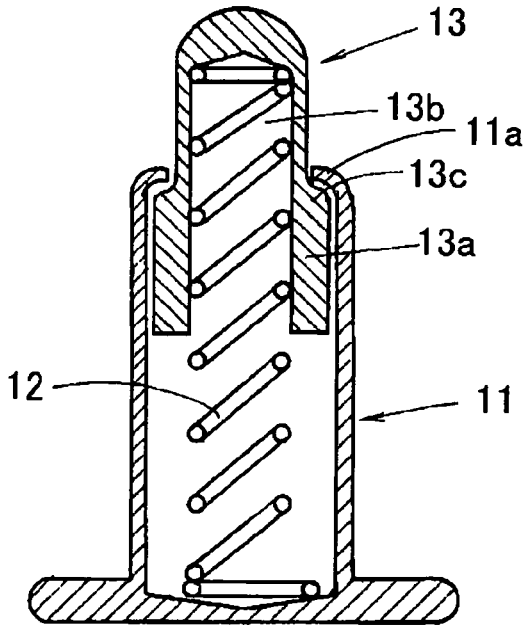
FIG. 2 PRIOR ART
FIG. 2 is a sectional view of a conventional spring connector.
Figure 3:
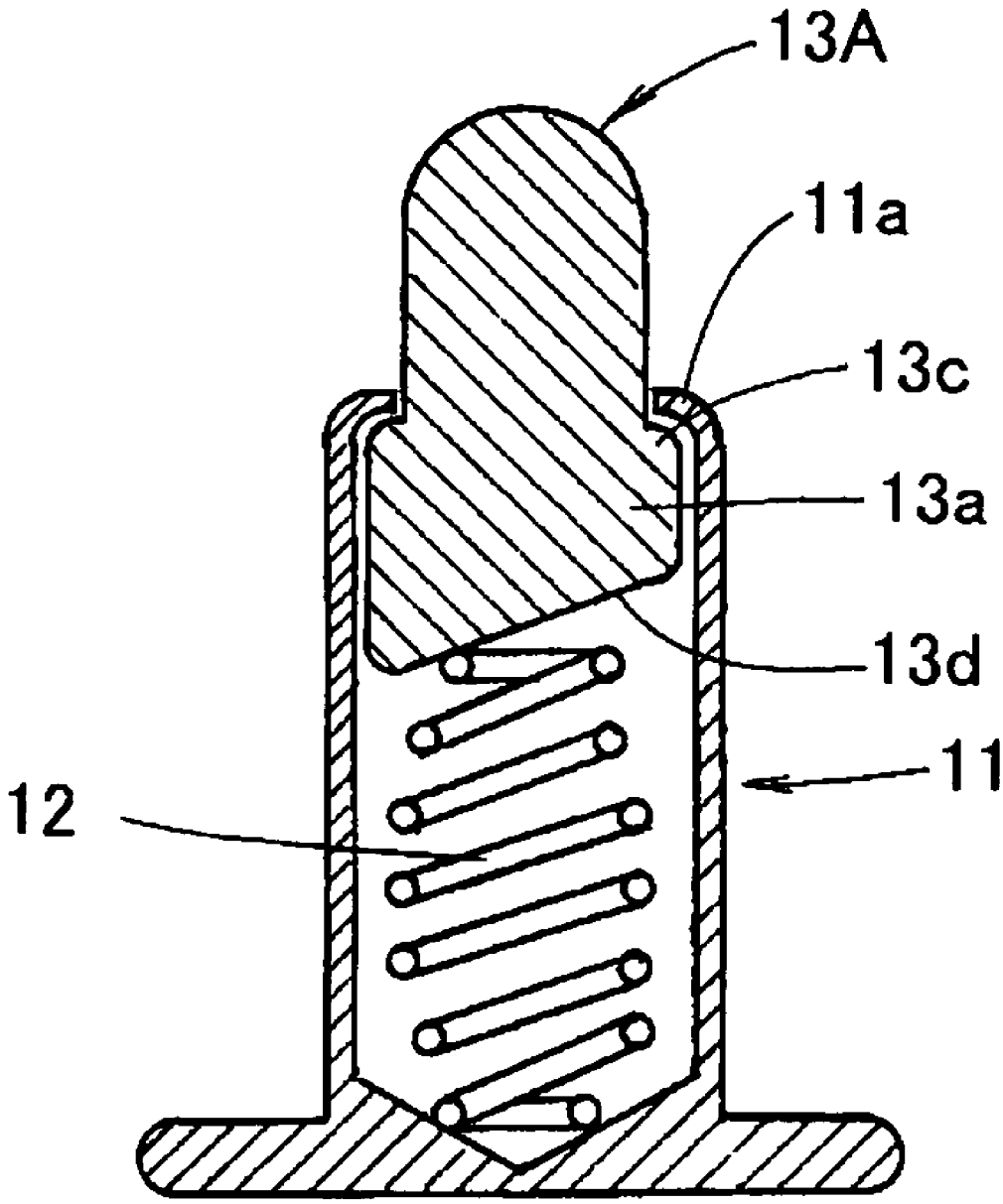
FIG. 3 PRIOR ART
FIG. 3 is a sectional view showing another conventional spring connector.

FIG. 1 is a sectional view of a spring connector according to the present invention.

Referring to FIG. 1, the spring connector comprises a cylindrical plunger 2 made of metal and a supporting member 1 made of metal and slidably inserted in the plunger 2. The supporting member 1 comprises a base 1*a* of a large diameter which is to be surface-mounted on a circuit substrate (not shown), a small diameter pillar 1*b* formed on the base 1*a*, and a head 1*d* having a diameter larger than that of the pillar 1*b*. The upper end of the head 1*d* is inclined with respect to the axis of the supporting member 1, thereby to form an inclined top surface 1*c*. An annular shoulder 1*e* is formed between the head 1*d* and the pillar 1*b*. Although the supporting member 1 may be machined, it is possible to manufacture the supporting member by press using a header comprising a die having a recess and a punch, in which case, the manufacturing cost can be reduced.

The cylindrical plunger 2 has a closed upper end 2*a* which is to be pressed against a terminal electrode of an electric part (not shown), and an annular bent portion 2*d* formed at a lower end thereof by squeezing action of a squeeze machine. An opening 2*b* is formed at a lower end of the cylindrical plunger 2 opposite the upper end 2*a* so as to be downwardly opened. A coil spring 3 is inserted in an inner space 2*c* inside the cylindrical plunger 2. An inner surface of the cylindrical plunger around the opening thereof is slidably pressed against the annular shoulder of the supporting member. The entire outer surfaces of both the cylindrical plunger 2 and the supporting member 1 are plated with gold.

In order to assemble the spring connector, the coil spring 3 is inserted in the cylindrical plunger 2 through the opening 2*b*. The head 1*d* of the supporting member 1 is then inserted in the cylindrical plunger 2 through the opening 2*b*. The periphery of the opening 2*b* is bent inward to form the annular bent portion 2*d* which covers the shoulder 1*e* of the supporting member 1. The bent portion 2*d* accordingly holds the supporting member 1 at the shoulder 1*e* so as to prevent the supporting member 1 from falling out of the plunger 2. The inner diameter of the inner space 2*c* of the cylindrical plunger 2 and the outer diameter of the head 1*d* of the supporting member 1 are set so that the plunger 2 is contacted with the head at a proper pressure so as to be smoothly slidable inside the plunger 2. The outer diameter of the pillar 1*b* and the inner diameter of the bent portion 2*d* are set so that the pillar 1*b* is smoothly slidable through the bent portion 2*d*. The cylindrical plunger 2 is formed by cutting and squeezing.

In operation, the base 1*a* of the supporting member 1 is mounted on a circuit substrate of an electronic device and the upper end 2*a* of the cylindrical plunger 2 is in contact with a terminal electrode of an electric part provided in the electronic device. When the cylindrical plunger 2 is pressed against the terminal electrode, the supporting member 1 is inserted deeper into the plunger 2 against the urging of the coil spring 3 so that the electrical connection between the terminal electrode and the circuit substrate is ensured. Since the pillar 1*b* of the supporting member 1 smoothly slides against the bent portion 2*d* of the plunger 2, and circumference surface of the head 1*d* is contacted with the inner surface of the plunger 2 at a proper pressure by the operation of the inclination of the inclined surface 1*c*, dirt is prevented from entering the cylindrical plunger through the opening 2*b*. Due to the inclination of the inclined surface 1*c*, the head 1*d* is pressed against the inner surface of the plunger 2. Thus the contact resistance is small and stable. Accordingly, the electrical conductivity between the cylindrical plunger 2 and the supporting member 1, and hence between the terminal electrode of the electric part and the circuit substrate is ensured.

Thus in accordance with the spring connector of the present invention, the head of the supporting member 1 is wrapped by the plunger and the opening of the plunger is downwardly opened so that dirt is not liable to enter the plunger, thereby rendering the contact resistance stable. Since the supporting member is provided with the inclined portion, the contact resistance is further maintained small and constant. The supporting member can be pressed using a header or cut and the plunger is formed by bending or by cutting so that the manufacturing cost of the spring connector is decreased. Thus inexpensive and reliable spring connector is provided.

While the invention has been described in conjunction with preferred specific embodiment thereof, it will be understood that this description is intended to illustrate and not limit the scope of the invention, which is defined by the following claims.

What is claimed is:

1. A spring connector comprising:

a supporting member comprising a base for mounting on a substrate, a pillar of diameter smaller than the base formed on the base, a head formed on the pillar and having a diameter larger than that of the pillar, an annular shoulder formed between the pillar and the head, and an upper end of the head having an inclined surface;

a cylindrical plunger having a closed upper end having a generally semicircular cross-section for contact with a terminal electrode, a lower end having an annular bent portion defining an opening, and an inner space in which the head of the supporting member is slidably inserted, an annular edge of the opening being slidably engaged with a peripheral wall of the pillar; and a coil spring provided in the inner space of the cylindrical plunger between the closed upper end and the inclined surface of the head so that the shoulder of the head is pressed against the annular bent portion of the opening.

2. The spring connector according to claim 1 wherein the supporting member is formed by using a header.

3. The spring connector according to claim 1 wherein the annular bent portion of the plunger is formed by a squeeze machine.

4. The spring connector according to claim 1 wherein outer surfaces of the supporting member and plunger are coated with Au film.

* * * * *